US006385231B2

(12) United States Patent
Tsuda et al.

(10) Patent No.: US 6,385,231 B2
(45) Date of Patent: May 7, 2002

(54) INDUCTION HEATING FURNACE AND BOTTOM TAPPING MECHANISM THEREOF

(75) Inventors: Masanori Tsuda; Atsushi Okuno; Yasuhiro Nakai, all of Ise (JP)

(73) Assignee: Shinko Electric Co., Ltd., Ise (JP)

( * ) Notice: Subject to any disclaimer, the term of this patent is extended or adjusted under 35 U.S.C. 154(b) by 0 days.

(21) Appl. No.: 09/840,106

(22) Filed: Apr. 24, 2001

Related U.S. Application Data

(63) Continuation of application No. 09/064,774, filed on Apr. 23, 1998.

(30) Foreign Application Priority Data

Apr. 23, 1997 (JP) ..... 9-118620
Feb. 16, 1998 (JP) ..... 10-032688

(51) Int. Cl.[7] ..... H05B 6/22
(52) U.S. Cl. ..... 373/142; 373/138
(58) Field of Search ..... 373/142, 138, 373/146, 151, 156, 139, 158; 164/503

(56) References Cited

U.S. PATENT DOCUMENTS 5,280,496 A * 1/1994 Schlecht et al. ..... 373/158
5,479,438 A * 12/1995 Blum et al. ..... 373/156
5,528,620 A * 6/1996 Fujita et al. ..... 373/139

* cited by examiner

*Primary Examiner*—Teresa Walberg
*Assistant Examiner*—Quang Van
(74) *Attorney, Agent, or Firm*—Oblon, Spivak, McClelland, Maier & Neustadt, P.C.

(57) ABSTRACT

An induction heating furnace includes a furnace body having a side wall extending so obliquely as to increase in radius from the bottom to the top edge portion and formed by a plurality of longitudinally split, conductive segments arrayed circumferentially and insulated from each other, a first induction heating coil arranged at an outer periphery of the side wall for subjecting a to-be-heated material accommodated in the furnace body to induction heating and a melt-use power source for supplying AC power to the first induction heating coil.

1 Claim, 11 Drawing Sheets

INDUCTION HEATING FURNACE AND BOTTOM TAPPING MECHANISM THEREOF

This application is a continuation of Ser. No. 09/064,774, filed Apr. 23, 1998.

BACKGROUND OF THE INVENTION

1. Field of the Invention

The present invention relates to an induction heating furnace for melting metals through induction heating and a bottom tapping mechanism thereof.

2. Description of the Related Art

In the case of producing a high purity metal or a metal alloy of desired components by melting a high reactive metal, attention has focused on an induction heating furnace which is capable of ensuring an uniform temperature over the entirety of a molten metal by induction heating and agitation to prevent variations in quality, and also suppressing the mixing of impurities into the molten metal to a low level, to prevent reduction in quality.

A conventional induction heating furnace has a side wall extending so obliquely as to increase an aperture from a bottom having a tapping portion to a certain point and then rising up vertically therefrom to an upper edge with the aperture kept at a constant diameter, as disclosed by, for example, Japanese Laid-open Patent No. Hei 4(1992)-327342. The side wall is formed by a plurality of longitudinally split, conductive segments arrayed circumferentially and insulated from each other. At the outer periphery of the side wall, an induction coil is arranged so that a metal at the inside of the side wall can be heated by induction heating. The tapping portion is provided with a mold to which a tapping passageway is communicated vertically. With the induction heating furnace thus constructed, the metal is melted by induction heating and then the molten metal flows into the tapping passageway of the mold, so as to be taken out with being solidified.

Also, Japanese Laid-open Patent No. Hei 8(1996)-145571 discloses an induction heating furnace including a side wall rising up vertically from a flat bottom having a tapping portion to an upper end, with an aperture kept at a constant diameter; and a bottom lid for closing the tapping portion. This induction heating furnace is so designed that when metal is melted by induction heating, the bottom lid can be melted to open the tapping portion, so as to take out the molten metal.

With the former arrangement in which the mold is provided at the tapping portion, a solidified layer in the tapping passageway in the mold and a solidified layer on the side wall become connected with each other. Due to this, taking out the metal from the mold requires a very large drawing force, thus causing difficulties in taking it out. Also, with the latter arrangement in which the tapping portion is closed with the bottom lid, once the bottom lid is melted to open the tapping portion, the tapping portion cannot be closed until all molten metal has completely been taken out. Due to this, switching between the melting of the metal and taking out the molten metal cannot be made smoothly. In short, the conventional type arrangements have a first problem that the melting of the metal and the task of taking out the molten metal cannot be made with ease and the switching operation between the melting of metal and taking out the molten metal cannot be made smoothly.

Further, where the side wall rises up with the aperture kept at a constant diameter, as in the above-described arrangement, when metallic vapor evaporates from the molten metal surface or the components of the gas produced in the molten metal dissipates from the molten metal surface, the evaporating direction of the metallic vapor or the rising direction of the gas become parallel to a wall surface of the side wall. Thus, the conventional arrangements have the second problem that the metal easily adheres to the side wall, thus requiring labor in the cleaning of the side wall, while the gas readily contacts the side wall to increase the flow resistance of the exhaust gas, which hinders the gas from being fully eliminated and causes a reduction of quality.

SUMMARY OF THE INVENTION

Accordingly, it is an object of the present invention to provide an induction heating furnace capable of solving at least one of the first and second problems described above, and a bottom tapping mechanism thereof According to a feature of the present invention, the above and other objects are accomplished by a novel induction heating furnace which comprises an accommodating vessel having a bottom, a tapping portion formed at the bottom, and a side wall formed by a plurality of longitudinally split, conductive segments arrayed circumferentially and insulated from each other for accommodating a to-be-melted material therein while cooling it; a coil arranged at an outer periphery of the tapping portion and the side wall for subjecting the to-be-melted material in the accommodating vessel to induction heating; a power source for supplying power to the coil; and a power source control for controlling the power source so that the tapping portion can be selectively switched between open and closed states by the melting and solidification of the to-be-melted material.

This construction can provide the following results. When the to-be-melted material accommodated in the accommodating vessel is subjected to induction heating, the to-be-melted material is melted while the molten material at the part contacting the side wall and a bottom wall of the accommodating vessel and the wall surface of the tapping portion is cooled and solidified. Thus, the power source control controlling the induction heating by the power source enables the tapping portion to be closed by the solidified material when the to-be-melted material is melted, and to be opened by melting the solidified material when the melted material is taken out. This enables the melting and removal of the material to be facilitated and also enables the switching operation between melting and takeout to be made with ease.

The induction heating furnace according to the invention may comprise an accommodating vessel having a bottom, a top edge portion and a side wall extending so obliquely as to increase in radius from the bottom to the top edge portion and formed by a plurality of longitudinally split, conductive segments arrayed circumferentially and insulated from each other; a coil arranged at an outer periphery of the side wall for subjecting a to-be-melted material accommodated in the accommodating vessel to induction heating; and a power source for supplying AC power to the coil.

This construction can provide the following results. When AC power is supplied to the coil from the power source, an alternating magnetic field is generated by the coil, whereby the to-be-melted material accommodated in the accommodating vessel is subjected to induction heating and is melted. When the to-be-melted material is thus melted material, the to-be-melted material evaporates at the molten material surface, and also components of gas produced in the molten material are discharged therefrom. At that time, the rise of the evaporated material and of the vaporized gas is not obstructed by the side wall, because the side wall of the accommodating vessel extends so obliquely as to increase in radius from the bottom to the top edge portion. Thus, almost no evaporated material contacts the side wall above the molten material surface, so that the drawbacks caused by the to-be-melted material adhering to the side wall are reduced. In addition, since almost no gas contacts the side wall, the flow resistance of the exhaust gas can be reduced and the gas can be fully eliminated.

Also, the induction heating furnace according to the present invention may comprise an accommodating vessel having a bottom, a top edge portion, a tapping portion formed at the bottom, and a side wall extending so obliquely as to increase in radius from the bottom to the top edge portion and formed by a plurality of longitudinally split, conductive segments arrayed circumferentially and insulated from each other; a coil arranged at an outer periphery of the tapping portion and the side wall for subjecting a to-be-heated material in the accommodating vessel to induction heating; a power source for supplying AC power to the coil; and a power source control for controlling the power source so that the tapping portion can be selectively switched between open and closed states by melting and solidification of the to-be-melted material.

This construction can provide the following results. When AC power is supplied to the coil means from the power source, an alternating magnetic field is generated by the coil, whereby the to-be-melted material accommodated in the accommodating vessel is subjected to induction heating and melted. When the to-be-melted material is so melted, the to-be-melted material evaporates from the molten material surface, and components of gas produced in the molten material are discharged therefrom. At that time, the rise of the evaporated material and of the vaporized gas is not obstructed by the side wall of the accommodating vessel because the side wall extends so obliquely as to increase in radius from the bottom to the top edge portion. Thus, almost no evaporated material contacts the side wall above the molten material surface, so that the drawbacks caused by the to-be-melted material adhering to the side wall are reduced. In addition, since almost no gas produced from the molten material contacts the side wall, the flow resistance of the exhaust gas can be reduced, and so the gas in the molten material can be fully eliminated.

Further, the control of induction heating by the power source can provide the result that when the to-be-melted material is to be melted, the tapping portion is closed by the solidified material, while when the melted material is to be taken out, the tapping portion is opened by melting the to-be-melted material. This enables the melting of the to-be-melted material and the takeout operation to be facilitated and also enables the switching between the melting and the takeout operations to be made with ease.

The tapping portion of the above-described induction heating furnace has an inlet portion which is joined to the bottom of the accommodating vessel and is so formed that an aperture of the inlet portion is gradually reduced in diameter from a top toward a bottom; and a hollow cylinder-like outlet portion is integrally formed with the inlet portion and is located below the inlet portion.

This construction can provide the result that the solidification of the to-be-melted material progresses along the wall surface of the tapping portion and then runs into the inner periphery. Accordingly, the closing operation of the tapping portion starts from the bottom of the inlet portion having a smallest aperture and progresses in sequence toward the top. Due to this, the entirety of the tapping portion can be prevented from being abruptly closed by a great force caused by solidification of the to-be-melted material, which allows the opening degree of the tapping portion to be varied with ease. As a result, the molten material can be taken out while the tapping amount of the molten material is finely adjusted.

Also, the coil of the induction heating furnace has an integral form comprising a first coil portion arranged at an outer periphery of the side wall and a second coil portion arranged at an outer periphery of the tapping portion, and the power source control controls the power source so that when the material is to be melted, the tapping portion is closed by part of the solidified material, whereas when the molten material is to be taken out, the part of the solidified material is allowed to melt to open the tapping portion.

This construction can provide the result that the first and second coil portions can be continuously formed by a single coil.

Also, in the induction heating furnace, the coil may be separated into a first coil portion arranged at the outer periphery of the side wall and the second coil portion arranged at the outer periphery of the tapping portion; the power source may comprise a first power source for supplying power to the first coil portion and a second power source for supplying power to the second coil portion; and the power source control may control the first power source and the second power source independently.

This construction can provide the result that the melting of the material and the takeout of the molten material can be done independently to provide improved productivity.

Preferably, the second power source comprises a melt-use power source portion for producing a first frequency of AC power to the extent that the to-be-melted material can be allowed to melt; and a solidification-use power source portion for producing a second frequency of AC power to the extent that the to-be-melted material is allowed to solidify, and the power source control functions such that when the tapping portion is opened, AC power can be produced from the melt-use power source portion, whereas when the tapping portion is closed, AC power is produced from the solidification-use power source portion.

This construction can provide the result that the tapping portion can be easily switched between open and closed states by switching between the melt-use power source portion and the solidification-use power source portion, and the tapping amounts can be easily adjusted by adjusting the time for supplying the high frequency power and the low frequency power.

Desirably, the induction heating furnace according to the invention may further comprise a drawing portion for forcibly drawing the to-be-melted material out from the tapping portion. This construction can provide the result that even when solidification of the melt is in progress, the to-be-melted material can be forcibly drawn out from the tapping portion, to obtain the to-be-melted material in a desired solidification state.

The induction heating furnace enables the to-be-melted material to be melted under a reduced pressure. This construction enables a proper use under a reduced pressure in which a large amount of gas is produced.

Also, a bottom tapping mechanism of an induction heating furnace includes: an inverted hollow-cone-shaped aperture bored in a bottom of an accommodating vessel for accommodating therein a molten material of a to-be-melted material; a funnel-shaped tapping portion comprising an inlet portion formed inside the aperture while contacting an inner periphery thereof and a hollow-pipe-like outlet portion integrally formed with and located below the inlet portion, the tapping portion being divided into a plurality of segments by a plurality of slits which are continuous to each other and are connected to cooling water feed/discharge pipes; induction heating coils arranged around the tapping portion at the inlet portion and the outlet portion, respectively; and a solidification-use power source portion and a melt-use power source portion which are selectively connected to the induction heating coils arbitrarily. This construction can provide the result that the time for the melt and the tapping of the molten material and the amount of the molten material can be controlled with a relatively simple structure.

Preferably, the above-described tapping portion comprises an inlet portion which is wide at a top end thereof and gradually narrows toward a bottom end thereof; and a hollow-pipe-like outlet portion extending downward in continuation to the inlet portion. This construction enables the opening degree of the tapping portion to be varied with ease, so that the molten material may be taken out while the tapping amount of the molten material is finely adjusted.

Further, the bottom tapping mechanism of the induction heating furnace is so constructed that when the tapping of the molten material is done, high-frequency power is supplied to the induction heating coils arranged around the tapping portion at the inlet portion and at the outlet portion, respectively, whereas when the tapping of the molten material is stopped, low frequency power is supplied thereto. This construction enables the bottom tapping mechanism to have a further simplified construction.

BRIEF DESCRIPTION OF THE DRAWINGS

The invention will now be described with reference to the accompanying drawings, wherein.

DETAILED DESCRIPTION OF THE PREFERRED EMBODIMENTS

The first embodiment of the present invention will be described below with reference to FIGS. 1 to 7.

Figure 2:
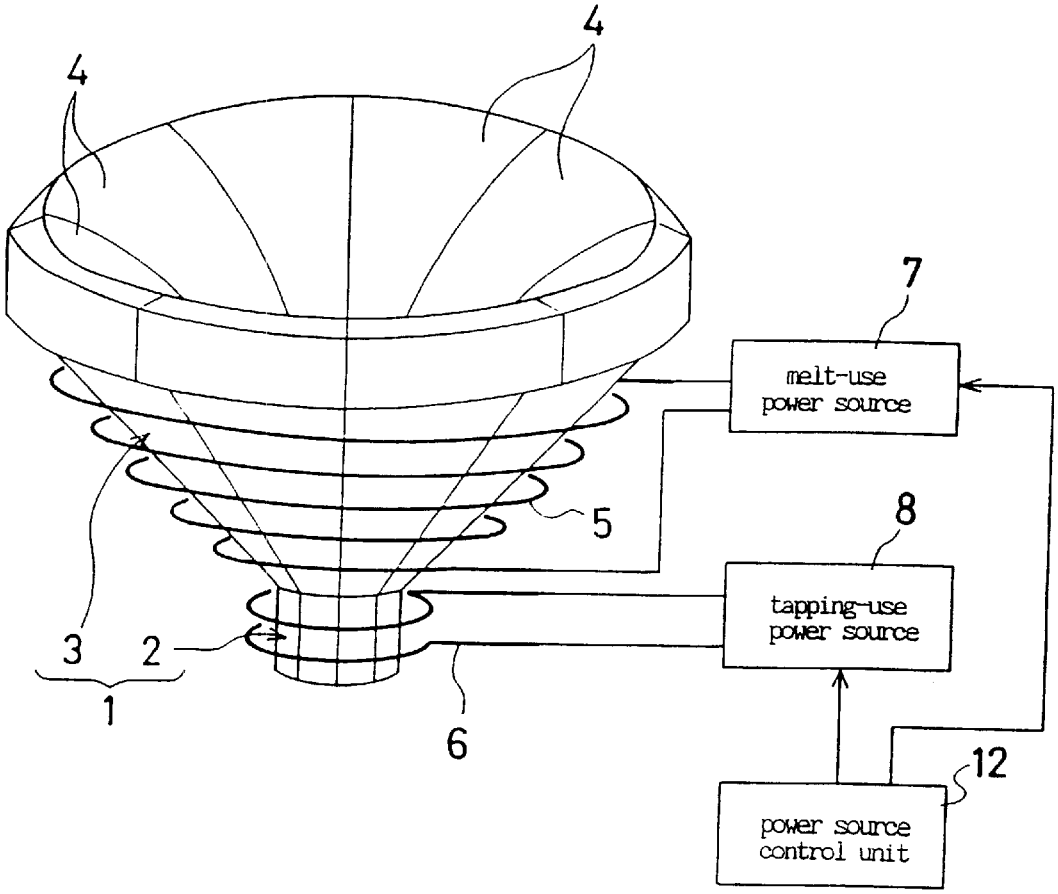
FIG. 2 is a perspective view of the induction heating furnace of FIG. 1.

The induction heating furnace of this embodiment has, as shown in FIG. 2, a furnace body 1 made of copper or copper alloy for accommodating therein a to-be-melted material 13 such as titanium. The furnace body 1 may instead be made of gold or silver which have low electrical resistivity or stainless steel. The to-be-melted material 13 may instead be zirconium, hafnium, chrome, niobium, tantalum, molybdenum, uranium, rare earth metal, thorium, and reactive metals consisting of metals selected from the alloys of such materials.

Figure 1:
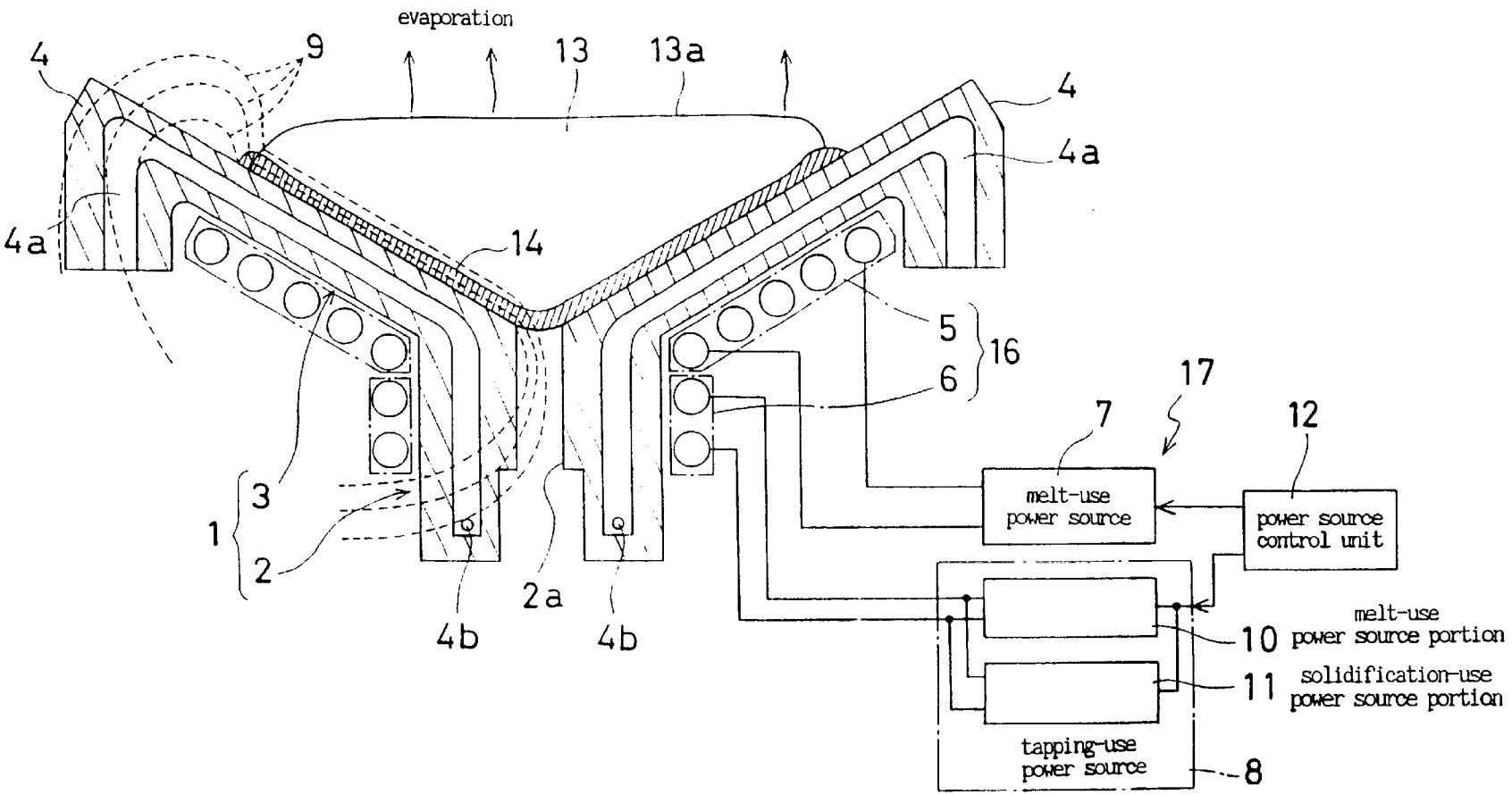
FIG. 1 is a diagrammatic illustration of an induction heating furnace of the first embodiment.

The furnace body 1 is arranged in a vacuum chamber, not shown, capable of being reduced to any selected atmospheric pressure between high vacuum and atmospheric pressure. The furnace body 1 has a tapping portion 2 located at the bottom and an inverted-circular-cone-shaped side wall 3 extending so obliquely as to increase in radius from the bottom to the top edge portion. The tapping portion 2 opens at the bottom of the furnace body 1, as shown in FIG. 1, and has a communicating hole 2*a* for forming a vertical communication for the opening. The tapping portion 2 and the side wall 3 are formed by a plurality of (eight) longitudinally split, conductive segments 4 arrayed circumferentially and insulated from each other. The insulation is provided by an insulating member interposed between neighboring conductive segments 4 or by the conductive segments 4 being kept apart from each other.

Each of the conductive segments 4 has an interior cooling water channel 4*a*. Each cooling water channel 4*a* extends from an upper end of the conductive segment 4 (an upper end of the side wall 3) to a lower end portion (a lower end portion of the tapping portion 2). The cooling water channels 4*a* at the upper ends of the segments 4 are connected to a cooling water supplying apparatus, not shown, and the cooling water channels 4*a* at the lower ends of the adjoining conductive segments 4 are connected to each other through communication channels 4*b*. The cooling water channels 4*a* in each set of two adjoining conductive segments 4 form a cooling system.

In this cooling system, cooling water is first introduced from the upper end of one of the two adjoining conductive segments 4 and flows down to the lower end of the one conductive segment 4, so as to cool the one conductive segment 4. Thereafter, the cooling water flows into the cooling water channel 4*a* of the other of the two adjoining conductive segments 4 through the communication channel 4*b* at the lower end and up to the upper end from the lower end, so as to cool the other conductive segment 4.

At the outer periphery of the furnace body 1, an induction heating coil 16 is separated into a first induction heating coil portion 5 and a second induction heating coil portion 6. The first induction heating coil portion 5 is wound around the side wall 3 from the bottom to the top end portion thereof, whereas the second induction heating coil portion 6 is wound around the tapping portion 2 from the bottom to the top end thereof. The first and second induction heating coil portions 5, 6 are connected to a melt-use power source 7 and a tapping-use power source 8 of a power unit 17, respectively, so that when AC power is supplied from these power sources 7, 8, an alternating magnetic field 9 is produced along the side wall 3 and a wall surface of the tapping portion 2, respectively.

The melt-use power source 7 produces a first frequency AC power to the extent that the to-be-melted material 13 is allowed to melt and also is so constructed as to change the frequency to any selected frequency. On the other hand, the tapping-use power source 8 has a melt-use power source portion 10 for producing the first frequency AC power to the extent that the to-be-melted material 13 is allowed to melt and a solidification-use power source portion 11 for producing a second frequency AC power to the extent that the to-be-melted material 13 is allowed to solidify. The power source portions 10, 11 are both constructed so as to change the frequencies to any selected frequencies, as in the melt-use power source 7.

The power source portions 10, 11 and the melt-use power source 7 are connected to a power source control unit 12. The first frequencies of the melt-use power source 7 and the melt-use power source portion 10 are set at a high frequency of the order of 2 kHz. The second frequency of the solidification-use power portion 11 is usually set at the commercial power frequency (at a low frequency of the order of 100–200 Hz). The power source control unit 12 enables the AC power output from each of the power sources 7, 8 to be selectively switched between on and off by outputting operation signals thereto and also enables the operation of the melt-use power source portion 10 and the operation of the solidification-use power source portion 11 to be selectively switched.

Operation of the induction heating furnace constructed as mentioned above will be described below.

First, the to-be-melted material 13 is dropped into the furnace body 1 from above. The furnace body 1 is formed into an inverted circular cone shape, with its side body 3 extending so obliquely as to increase in radius from the bottom to the top edge portion, and accordingly has the largest aperture at the top edge portion. Therefore, even when the to-be-melted material 13 is dropped at a deviated position or in large amounts, all of the material 13 is surely retained in the furnace body 1.

Figure 3:
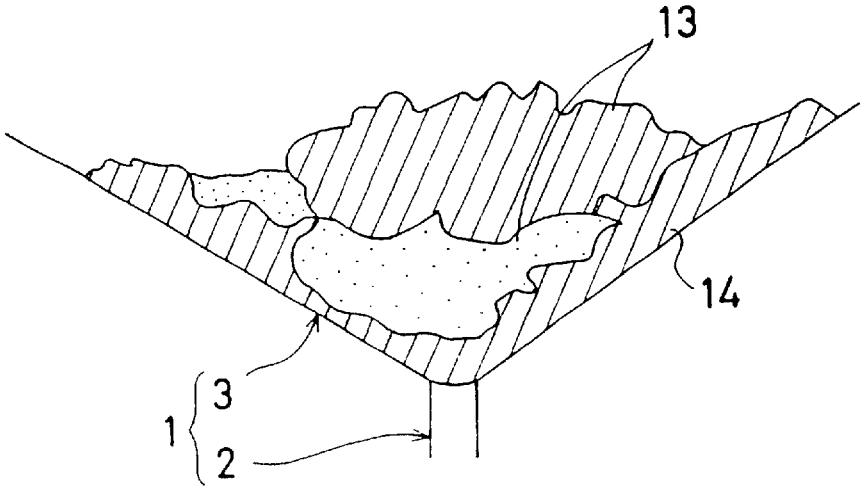
FIG. 3 is an illustration showing a to-be-melted material which is in the process of being melted.

Thereafter, the furnace body 1 is cooled by flowing the cooling water through the cooling water channel 4*a* for completion of the preparation for melting. When an operator enters a melt starting command into the power source control unit 12, the power source control unit 12 puts the melt-use power source 7 into an on mode, so as to output the first frequency (high frequency) AC power to the first induction heating coil portion 5. When the first induction heating coil portion 5 is supplied with AC power, the alternating magnetic field 9 is produced from the first induction heating coil portion 5 along the side wall 3, and the solid material 13 is subjected to induction heating by the alternating magnetic field 9 and thereby is melted at its surface. However, the melted material 13 contacting the cooled side wall 3 is resolidified by the cooling action of the side wall 3, and thereby forms a container-shaped skull 14 along the side wall 3. Thus, in the early stage of melting, a mixture of molten and solid material 13 is positioned on a large layer of skull 14, as shown in FIG. 3.

Figure 4:
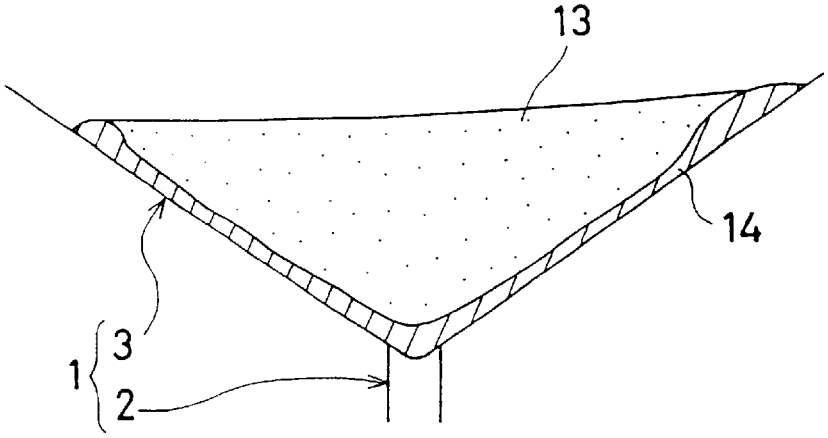
FIG. 4 is an illustration showing the melted material.

Thereafter, the material 13 is fully melted and accommodated in the containing portion defined by the skull 14, as shown in FIG. 4. Since the second induction heating coil portion 6 is not yet energized, only a small alternating magnetic field 9 produced by the first induction heating coil portion 5 is formed around the tapping portion 2. Thus, the tapping portion 2 is closed by the large layer of skull 14 formed by the cooling of the side wall 3.

Figure 5:
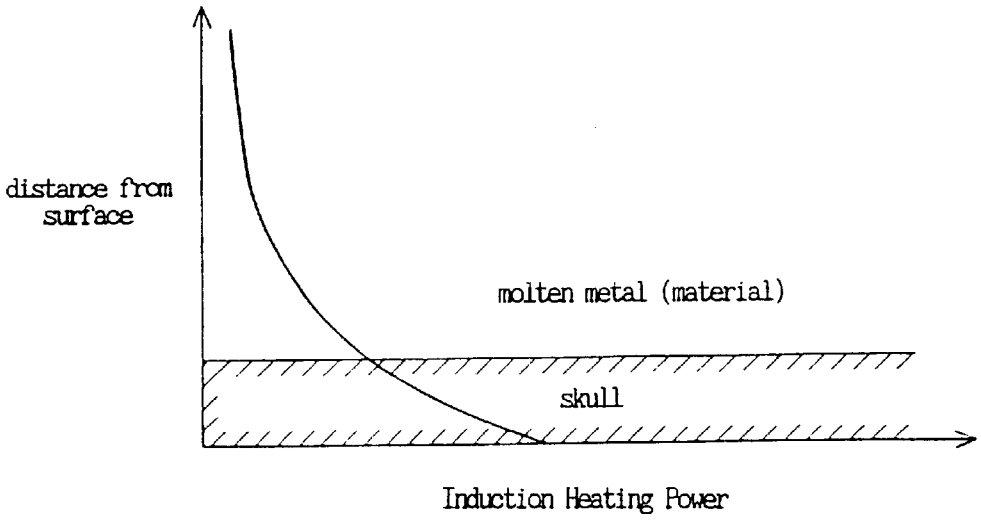
FIG. 5 is an illustration showing a thickness of a layer of skull, and the relationship between the distance from surface and induction heating power.

Thereafter, induction heating power is applied, as shown in FIG. 5, in such a manner as to achieve equilibrium, with the layer of the skull 14 having a desired thickness, as shown in FIG. 1. It is noted that though the factors for heat dissipation of the melted material 13 include radiation from the molten material surface 13*a*, convection above the molten material surface 13*a* and cooling by the side wall 3, the thickness of the layer of the skull 14 is determined mainly by cooling by the side wall 3 and the level of induction heating by the alternating magnetic field 9.

When the to-be-melted material 13 melts into the molten material as mentioned above, some of the material 13 evaporates from the molten material surface 13*a*, and components of gas produced in the molten material are discharged therefrom. At that time, the rise of the evaporated material 13 and of the components of vaporized gas (in the direction indicated by an arrow) is not obstructed by the side wall 3, because the side wall 3 extends so obliquely as to increase in radius from the bottom to the top edge portion. Accordingly, almost no evaporated material 13 contacts with the side wall 3 above the molten material surface 13*a*, so that the adherence of the material 13 to the side wall 3 is reduced. In addition, since almost no gas rising from the molten material surface 13*a* contacts the side wall 3, the flow resistance of the exhaust of gas is reduced and thereby gas in the molten material is fully eliminated.

Next, when the molten material 13 is to be taken out, the melt-use power source portion 10 is put into an on mode, so as to output the first frequency (high frequency) AC power to the second induction heating coil portion 6. When the second induction heating coil 6 portion is supplied with AC power, an alternating magnetic field 9 is produced around the tapping portion 2 by the second induction heating coil 6. This causes the skull 14 existing at an upper part of the tapping portion 2 to be melted by induction heating, and thereby the tapping portion 2 is put into an open state and the molten material 13 is removed by gravity through the tapping portion 2.

When the take-out of the molten material is to be interrupted or the amount of the molten material to be taken out is regulated, the power supply to the second induction heating coil portion 6 is switched from the melt-use power source portion 10 to the solidification-use power source portion 11. Upon switching to the solidification-use power source portion 11, the second frequency (low frequency) alternating magnetic field 9 is produced around the tapping portion 2, so that eddy currents are induced, running considerably deep into the molten material from the surface thereof. The electric power density at that part is reduced, and resultantly the molten material is lifted up solely by the magnetic pressure, rather than by heating. As a result, the pressure applied to the tapping portion 2 by the molten materials weight is reduced, and thereby the flow amount of molten material is reduced.

As the molten material flow rate falls, the amount of heat supplied from the molten material also falls, so that solidification of the molten material begins from its part contacting the tapping portion 2 to allow the molten material flow rate to further fall and, in turn, to allow the aperture at the tapping portion 2 to be gradually reduced in diameter. By allowing the solidification of the material 13 to progress, the tapping portion 2 can be closed completely to stop the tapping of the molten material. On the other hand, when the aperture at the tapping portion 2 reaches a predetermined diameter, the power supply to the second induction heating coil portion 6 may be switched from the solidification-use power source portion 11 to the melt-use power source portion 10. This can produce the result that after the reduction in diameter of the aperture at the tapping portion 2 is caused to stop, the diameter of the aperture is caused to increase. Thus, the control of the switching between the melt-use power source portion 10 and the solidification-use power source portion 11 can allow the aperture at the tapping portion 2 to be kept at a constant diameter, so as to take out a specified amount of the to-be-melted material 13.

As mentioned above, the induction heating furnace of the first embodiment has the furnace body 1 (accommodating vessel) having the side wall 3 which extends so obliquely as to increase in radius from the bottom to the top edge portion and which is formed by a plurality of longitudinally split, conductive segments 4 arrayed circumferentially and insulated from each other; the first induction heating coil portion 5, arranged at the outer periphery side of the side wall 3 for subjecting the to-be-heated material 13 in the furnace body 1 to induction heating; and the melt-use power source 7 (the first power supply) supplying AC power for the first induction heating coil portion 5.

As long as the induction heating furnace has the first construction, the furnace body 1 may be provided at its bottom with the tapping portion 2 for taking out the material 13 therefrom, as in the embodied form, or may be so modified that the material 13 can be taken out by tilting the furnace body 1 without providing the tapping portion 2. Also, as long as the side wall 3 extends so obliquely as to increase in radius from the bottom to the top edge portion, the side wall may have a linear form or a curved form.

With the first construction, when AC power is supplied to the first induction heating coil portion 5 from the melt-use power source 7, the alternating magnetic field 9 is produced by the induction heating coil portion 5 so that the material 13 accommodated in the furnace body 1 is subjected to induction heating, to be melted. When the to-be-melted material 13 is so melted, a portion evaporates from the molten material surface 13*a* and components of gas produced in the molten material are discharged therefrom. At that time, the rise of the evaporated material 13 and of the vaporized gas components is not obstructed by the side wall 3, because the side wall 3 extends so obliquely as to increase in radius from the bottom to the top edge portion.

Accordingly, almost no evaporated material 13 contacts the side wall 3 above the molten material surface 13*a*, so that the drawbacks caused by large amounts of material 13 adhering to the side wall 3 are reduced. Specifically, reduction in purity of the material 13 and impurities in component ratio, which are caused by a large amount of impurities containing deposits being dropped into the molten material, can be reduced and also labor required for the deposits to be eliminated can be reduced. In addition, since almost no gas evaporating on the molten material surface 13*a* and rising therefrom contacts the side wall 3, the flow resistance of the exhaust of gas can be reduced and the gas components in the molten material can be fully eliminated.

The induction heating furnace of this embodiment has, in addition to the above-described first construction, a second construction having the tapping portion 2 formed at the bottom of the side wall 3; the second induction heating coil portion 6 portion arranged at the outer periphery side of the tapping portion 2 for subjecting the to-be-heated material 13 to induction heating; a tapping-use power source (the second power source) 8 for supplying AC power to the second induction heating coil portion 6; and the power source control unit 12 for controlling the tapping-use power source 8 so that the tapping portion 2 can be selectively switched between open and closed states by the melting and solidification of the material 13.

Figure 6:
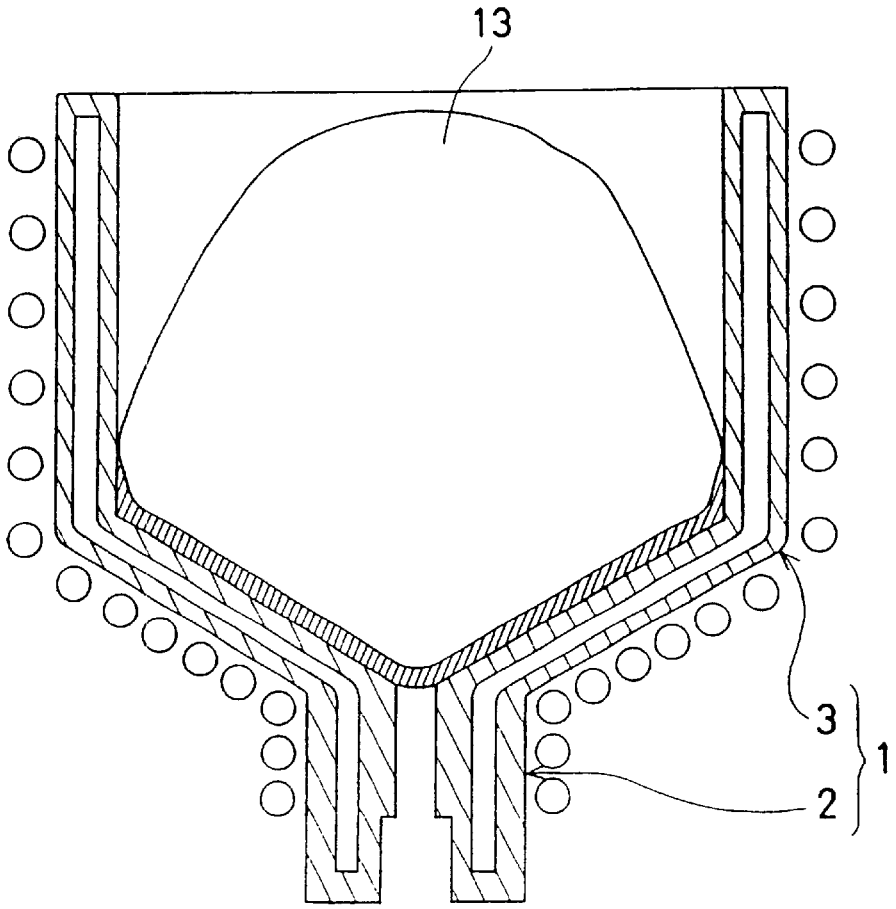
FIG. 6 is a diagrammatic construction view of the induction heating furnace.

It is noted that as long as the induction heating furnace has the second construction, the side wall 3 of the furnace body 1 may be so modified as to extend so obliquely as to increase in radius from the bottom until a certain point and then rise up vertically therefrom, as shown in FIG. 6.

According to the second construction, when the to-be-melted material 13 accommodated in the furnace body 1 is subjected to the induction heating, the material 13 is melted by the heating, whereas the molten material at a part contacting the side wall 3 and a bottom wall of the furnace body 1 and the wall surface of the tapping portion 2 is cooled down into a solidified state. Thus, the control of induction heating caused by the tapping-use power source 8 enables the tapping portion 2 to be closed by the solidified material 13 (the skull 14) when the material 13 is melted, but be opened by melting the skull 14 when the molten material 13 is taken out. This enables the melting and take-out of the material 13 to be facilitated and also enables easy switching between melting and take-out operations.

Also, the induction heating furnace of this embodiment includes the induction heating coil 16 being separated into the first induction heating coil portion 5 and the second induction heating coil 6; and the power unit 17 having the melt-use power source 7 (the first power source) for supplying AC power to the first induction heating coil portion 5 and the tapping-use power source 8 (the second power source) for supplying AC power to the second induction heating coil 6 portion. The melt-use power source 7 and the tapping-use power source 8 are separately controlled by the power control unit 12. This permits the melting of the material 13 caused by induction heating by the first induction heating coil portion 5 and the take-out of the molten material produced by the induction heating by the second induction heating coil portion 6 to be done separately, thus providing improved productivity.

Further, the induction heating furnace of this embodiment includes the tapping-use power source 8 having the melt-use power source portion 10 for producing the first frequency AC power to the extent that the to-be-melted material 13 is allowed to melt and the solidification-use power source portion 11 for producing the second frequency AC power to the extent that the melted material 13 is allowed to solidify. The power source control unit 12 allows AC power to be outputted from the melt-use power source portion 10 when the tapping portion 2 is to be opened but allows AC power to be output from the solidification-use power source portion 11 when the tapping portion 2 is to be closed. This enables the tapping portion 2 to be easily switched between open and closed states by switching between the melt-use power source portion 10 and the solidification-use power source portion 11, and also enables the tapping amounts to be easily adjusted by adjusting the time for supplying the first frequency of and the second frequency AC power.

Figure 7:
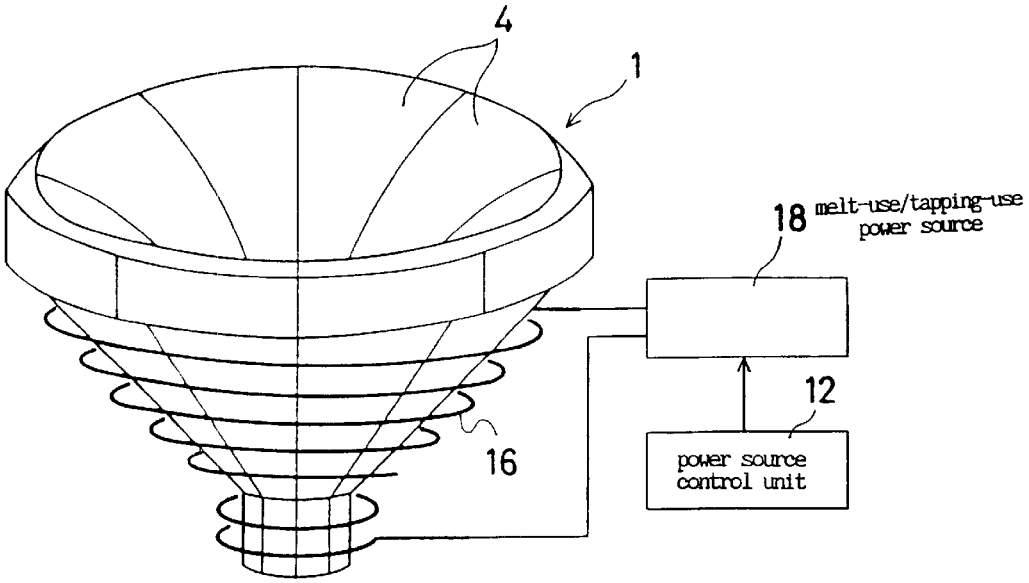
FIG. 7 is a perspective view of the induction heating furnace.

In this embodiment, the induction heating coil 16 is separated into first induction heating coil portion 5 and second induction heating coil portion 6 so that the respective coil portions 5, 6 can be allowed to operate separately from each other, but this construction is not restrictive. The induction heating furnace may be so modified, as shown in FIG. 7, as to comprise an integrally formed induction heating coil 16 including the first induction heating coil portion 5 and the second induction heating coil portion 6; a melt-use/tapping-use power source 18 capable of supplying AC power to the coil 16 at any selected frequency; and a power source control unit 12 capable of controlling the melt-use/tapping-use power source 18 such that the tapping portion 2 can be closed by the solidified material 13 when the material 13 is melted and to be opened by melting the solidified material 13 when the molten material 13 is taken out.

Next, the second embodiment of the invention will be described with reference to FIGS. 8 to 11. The same functional members as those in the first embodiment are given the same reference numerals and the description thereof will be omitted.

Figure 8:
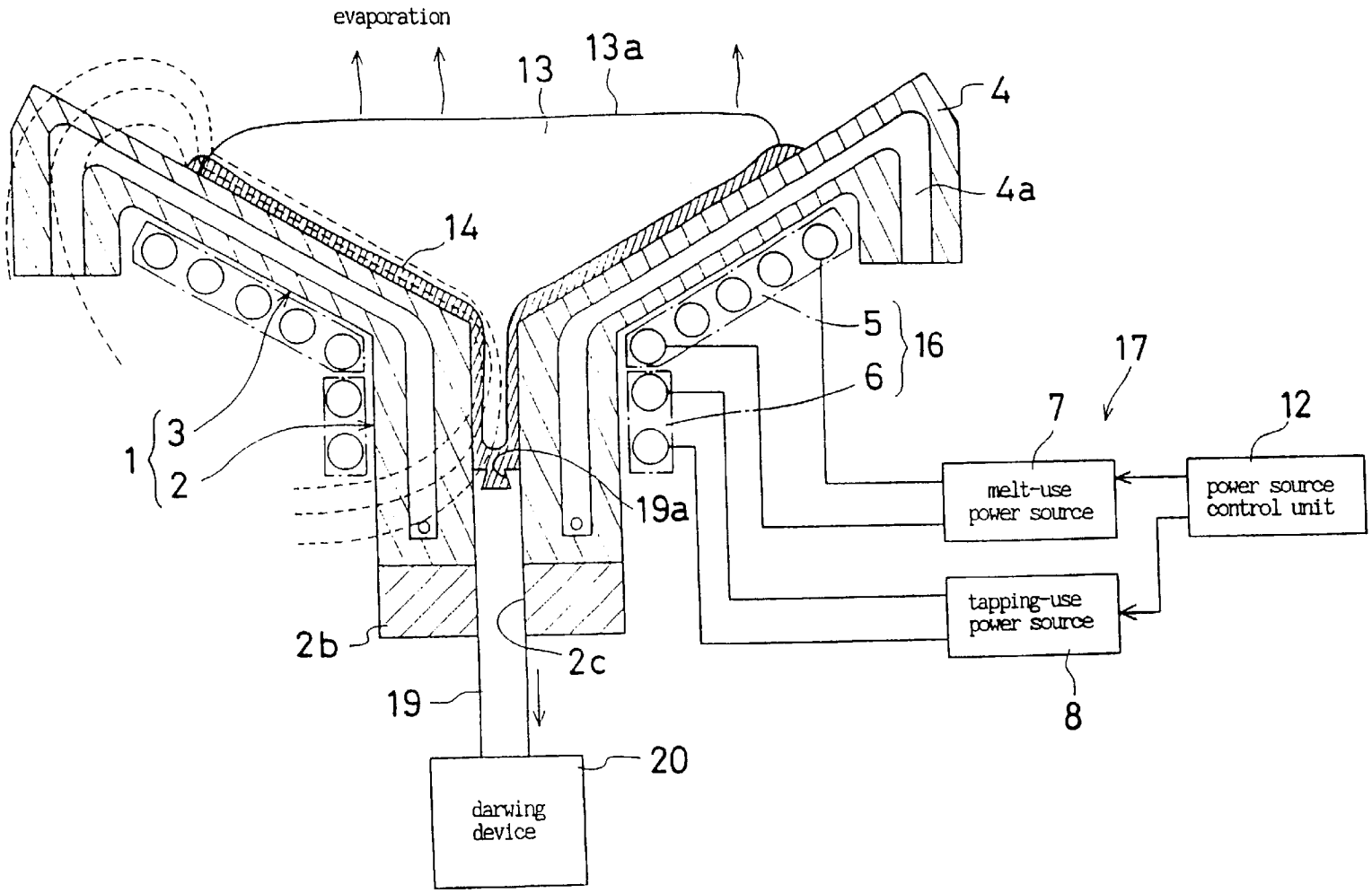
FIG. 8 is a diagrammatic construction view of an induction heating furnace of the second embodiment.
Figure 9:
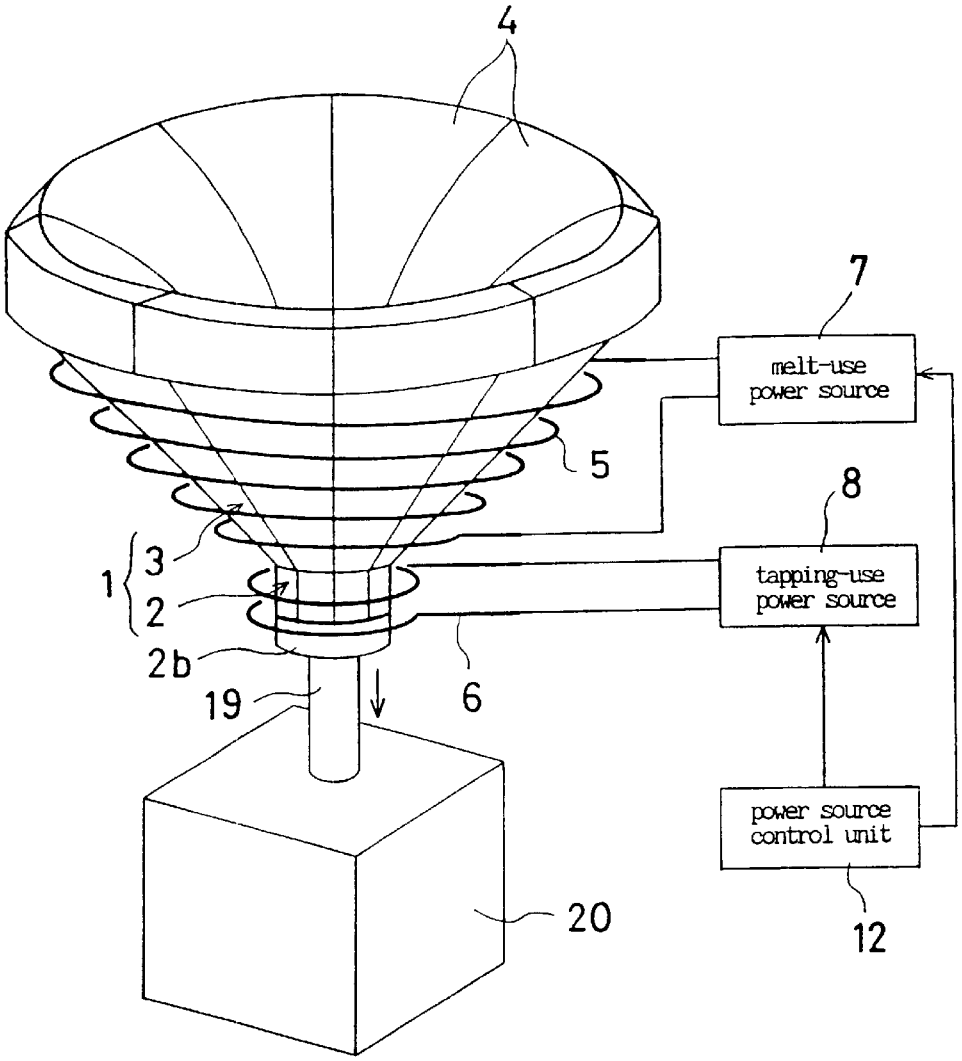
FIG. 9 is a perspective view of the induction heating furnace of FIG. 8.

As shown in FIG. 9, the induction heating furnace of the second embodiment has the furnace body 1 (accommodating vessel) including the tapping portion 2 at the bottom and the side wall 3 extending so obliquely as to increase in radius from the bottom to the top edge portion and formed by a plurality of longitudinally split, conductive segments 4 arrayed circumferentially and insulated from each other. At the outer periphery of the furnace body 1 is provided the induction heating coil 16 by which the to-be-melted material 13 accommodated in the furnace body 1 is subjected to the induction heating, as shown in FIG. 8.

The induction heating coil 16 is separated into first induction heating coil portion 5 disposed around the periphery of the side wall 3 and second induction heating coil portion 6 disposed around the periphery of the tapping portion 2. These coil portions 5, 6 are connected to the melt-use power source 7 and the tapping-use power source 8, respectively. The power unit 17 for coil portions 5, 6 is connected to the power source control unit 12.

The above-described tapping portion 2 has a communication hole 2*c* extending vertically through the tapping portion with a constant diameter and an inductive short-circuit portion 2*b* at the bottom. The short-circuit portion 2*b* is electrically connected with each of the conductive segments 4 to suppress penetration of the alternating magnetic field 9 to the communication hole 2*c*, so as to allow the solidification of the material 13 to be accelerated. Also, a rod-like starting block 19, cooled by cooling water and the like, is movably inserted in the communication hole 2*c* of the tapping portion 2. The starting block 19 is provided, on its top surface, with an engaging portion 19*a* having an aperture progressively increasing in diameter from a top end to a bottom end. The engaging portion 19*a* is adapted to be engaged with the solidified material 13 to surely apply a drawing power to the material 13. The starting block 19 is connected with a drawing device 20 capable of moving the starting block 19 up and down at any speed and timing. The remaining construction is identical to that in the first embodiment, so the description thereof is omitted.

The operation of the induction heating furnace constructed as described above will be described below.

The to-be-melted material 13 is dropped into the furnace body 1 and the furnace body 1 is cooled down by flowing cooling water through the cooling water channel 4*a* for completion of the preparation for melting. Then, AC power is outputted to the first induction heating coil portion 5 and the second induction heating coil portion 6 by putting the melt-use power source 7 and the tapping-use power source 8 into an on mode. When the coil portions 5, 6 are supplied with AC power, the alternating magnetic field 9 is produced along the surface of the side wall 3 and the communication hole 2*c* at the tapping portion 2.

Figure 10:
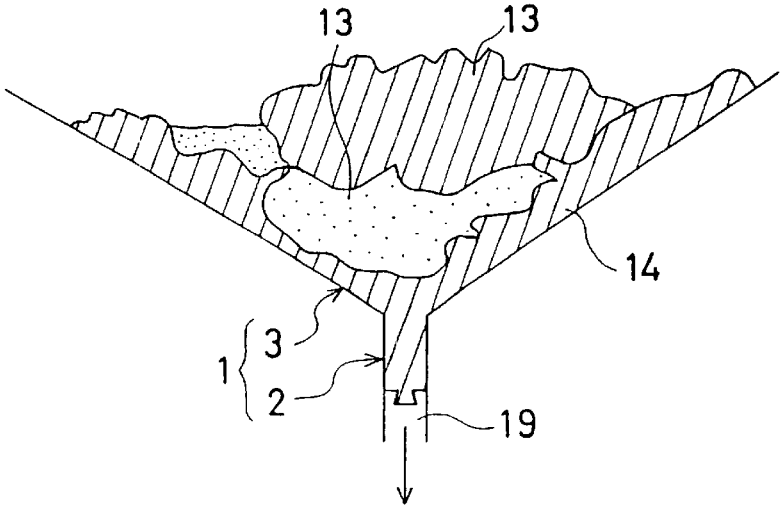
FIG. 10 is an illustration showing material which is in the process of being melted.

The solid block of material 13 is subjected to induction heating by the alternating magnetic field 9, and thereby is melted from its surface. Upon contacting the side wall 3, the tapping portion 2 and the starting block 19, the molten material 13 is solidified again by the cooling action thereof, thereby forming skull 14. Thus, in the early stage of melting, a mixture of molten and solid material 13 is positioned on a large layer of skull 14, as shown in FIG. 10.

Thereafter, when the induction heating continues to melt the entirety of the to-be-melted material 13, a portion of the melted material 13 is evaporated from the molten material surface 13*a*, and gas components containing impurities produced in the molten material rise up and are discharged from the molten material surface 13*a*, as shown in FIG. 8. At that time, the evaporated material 13 and the components of gas are not obstructed by the side wall 3, because the side wall 3 extends so obliquely as to increase in radius from the bottom to the top edge portion. Accordingly, almost no evaporating material 13 contacts the side wall 3 above the molten material surface 13*a*, so that adherence of the material 13 to the side wall 3 is reduced. In addition, since almost no gas components vaporizing on the molten material surface 13*a* contact the side wall 3, the flow resistance of the exhaust of gas is reduced and thereby gas in the molten material is fully eliminated.

Figure 11:
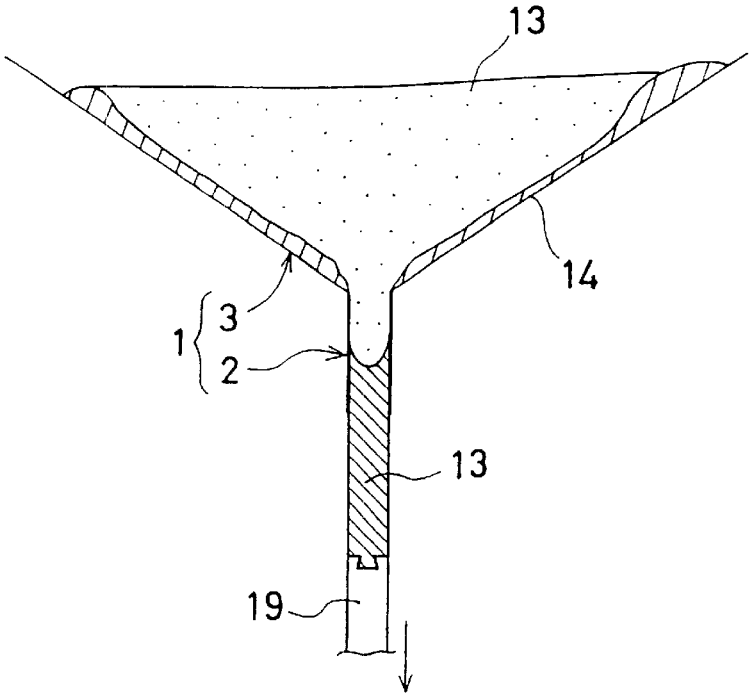
FIG. 11 is an illustration showing the material which has been melted.

Next, when the molten material 13 is to be taken out, the power supply from the tapping-use power source 8 to the second induction heating coil portion 6 is increased to the extent that the skull 14 is allowed to be melt. Thereafter, the drawing device 20 is actuated to lower the starting block 19. When the starting block 19 is lowered, the drawing force of the starting block 19 is surely applied to the solidified material 13 engaged with the engaging portion 19*a* of the starting block 19, and thus the material 13 is lowered together with the starting block 19. The solidification of the melted material 13 is further accelerated in the short-circuit portion 2*b* of the tapping portion 2, and thereafter the material 13 developing into a desired solidification state is drawn out from the tapping portion 2, as shown in FIG. 11.

As discussed above, the induction heating furnace of the second embodiment has the starting block 19 for enabling the melted material 13 to be forcibly drawn out from the tapping portion 2; and the drawing device 20. This enables the material 13 to be forcibly drawn out from the tapping portion 2, to obtain the material 13 in a desired solidification state.

In the second embodiment, the induction heating coil 16 may-be composed of a single coil, rather than of the first induction coil portion 5 and the second induction heating coil portion 6. Also, the power unit 17 may be composed of a single power source, rather than of the melt-use power source 7 and the tapping-use power source 8.

Next, the third embodiment of the invention will be described with reference to FIGS. 12(A)–12(C) and 13.

Figure 12:
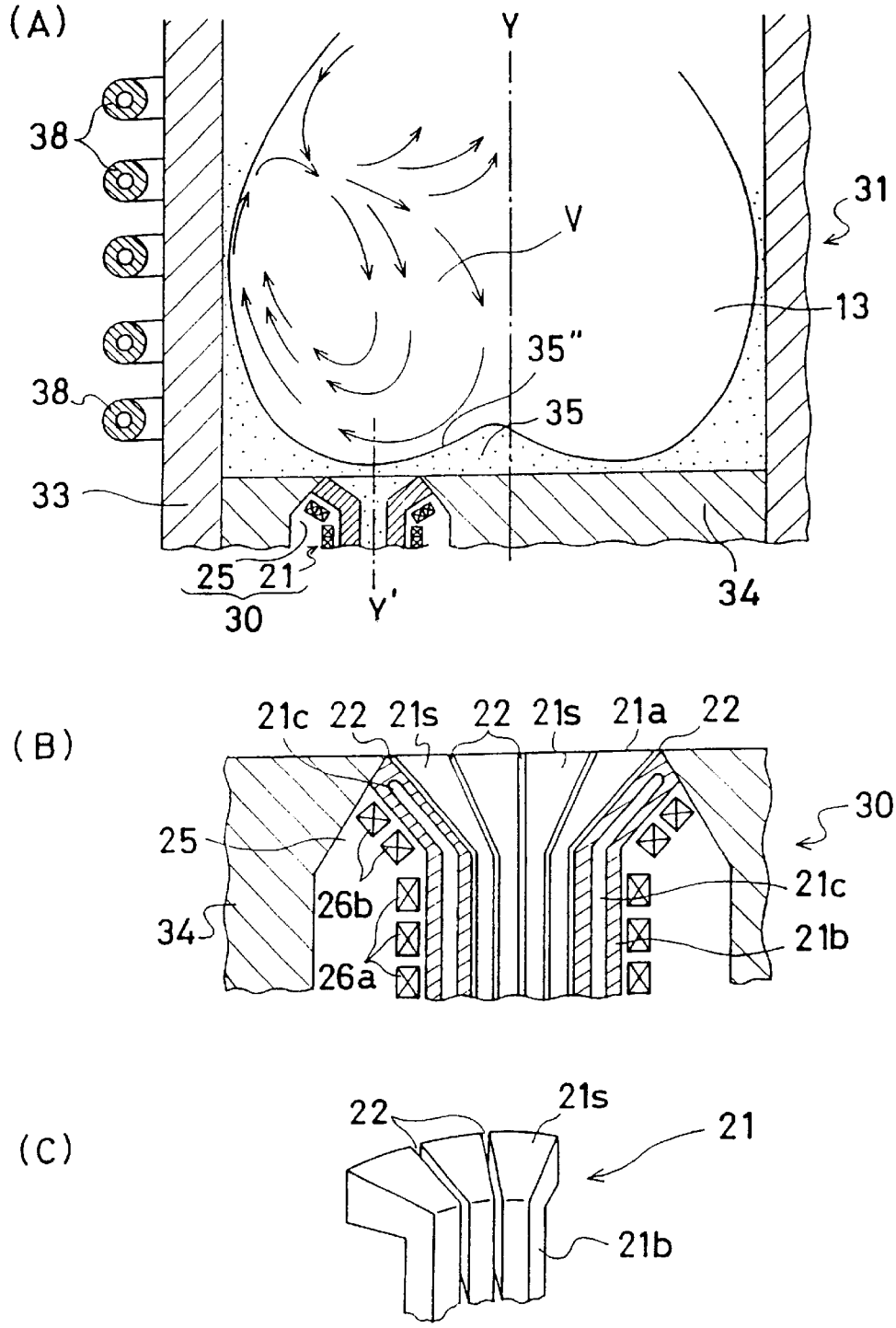
FIG. 12(A) is a diagrammatic side view of an induction heating furnace of the third embodiment.
FIG. 12(B) is a diagrammatic enlarged sectional view of an induction heating furnace of the third embodiment.
FIG. 12(C) is a perspective view of the tapping portion of an induction heating furnace of the third embodiment.

As shown in FIG. 12(A), the induction heating furnace of the third embodiment has a furnace body 31 comprising a cylindrical side wall 33 around which an induction heating coil 38 is wound and a flat plate-like bottom wall 34 forming the bottom of the side wall 33, and is formed by a plurality of longitudinally split, conductive segments arrayed circumferentially and insulated from each other. On a lower surface of the bottom wall 34 is provided a bottom tapping mechanism 30 having an inverted-hollow-cone-shaped aperture 25 bored in the bottom wall 34 of the furnace body 31 and a tapping portion 21 provided in the aperture 25.

As shown in FIG. 12(B) as well, an upper end portion of the tapping portion 21 is joined to the aperture 25. The tapping portion 21 comprises a funnel-shaped inlet portion 21*a* which is wide at the top end and progressively narrows to a given width; and a hollow-pipe-like outlet portion 21*b* extending downward in continuation to the inlet portion 21*a*. The tapping portion is L-like in section and is formed into a funnel shaped as a whole.

Figure 13:
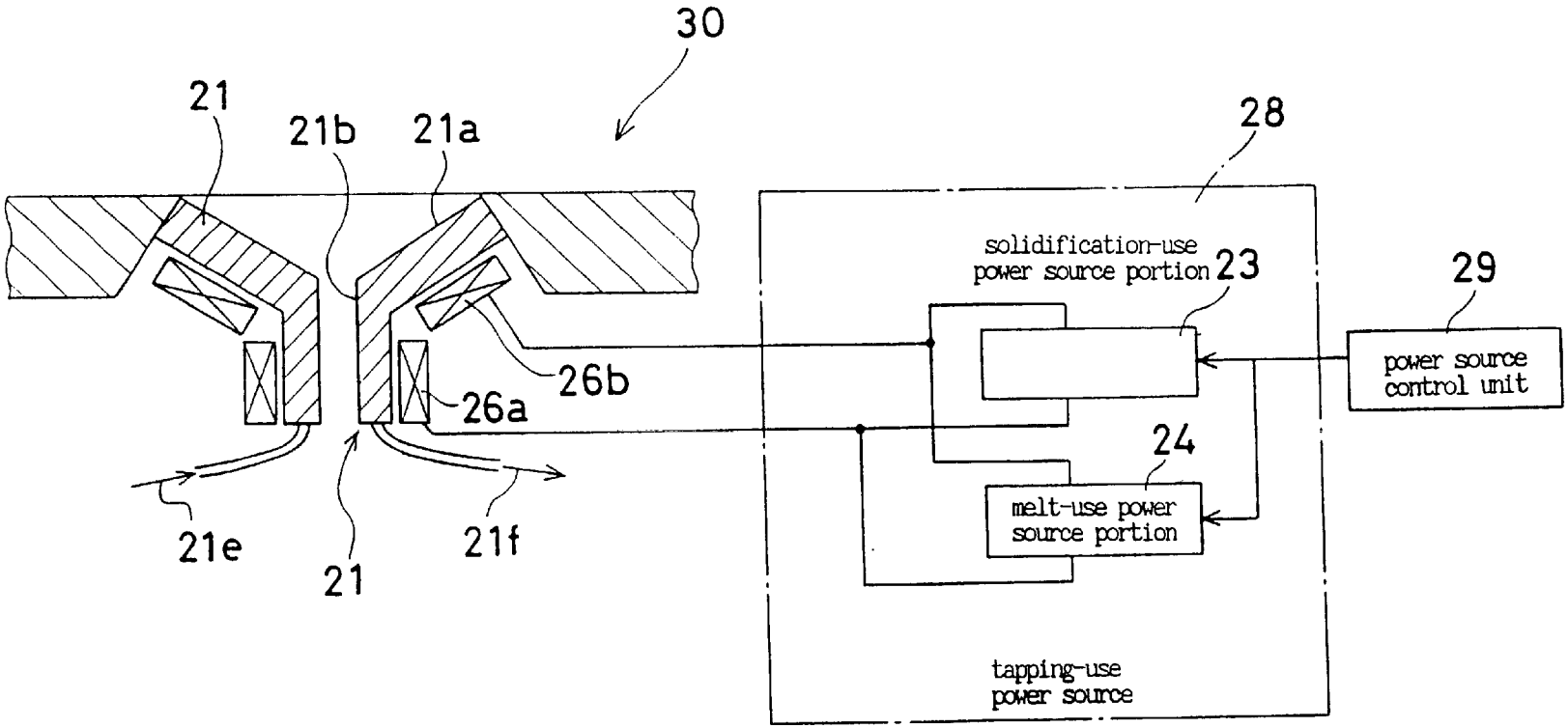
FIG. 13 is a diagrammatic construction view of a bottom tapping mechanism of the third embodiment.

Also, as shown in FIG. 12(C), the tapping portion 21 is divided into a plurality of conductive segments 21*s* by a plurality of axially extending slits 22. Each of the segments 21*s* has an internal hollow portion 21*c* forming a cooling water passageway. To the end of the hollow portion 21*c* are connected a cooling water inlet pipe 21*e* and a cooling water outlet pipe 21*f*, as shown in FIG. 13.

Around the outlet portion 21*b* and the inlet portion 21*a* of the tapping portion 21, induction heating coils 26*b*, 26*a* are respectively arranged along the outer surfaces thereof. These induction heating coils 26*a*, 26*b* are connected to a tapping-use power source 28 for producing AC power. The tapping-use power source 28 has a solidification-use power source portion 23 for producing the second frequency AC power to the extent that the melted material 13 can be allowed to solidify and the melt-use power source portion 24 for producing the first frequency AC power to the extent that the to-be-melted material 13 is allowed to melt. The first frequency of the melt-use power source portion 24 is set to be higher than the second frequency of the solidification-use power source portion 23. The tapping-use power source 28 is connected to a power source control unit 29 which is adapted to control the tapping-use power source 28 to selectively switch between the operation of the solidification-use power source portion 23 and the operation of the melt-use power source portion 24.

In the above-described construction, when melting and the tapping are performed, the melt-use induction heating coil 38 arranged around the side wall 33 is energized to melt the to-be-melted material 13, as shown in FIG. 12(A). At the point in time at which the material 13 being progressively molten in the furnace body 31 develops into a specified melted condition, the tapping is started. Specifically, as shown in FIG. 13, the first frequency of high-frequency power is supplied from the melt-use power source portion 24 to the induction heating coils 26*a*, 26*b*. When the first frequency of high-frequency power is supplied to the lower induction heating coil 26*a*, the high-frequency alternating magnetic field is produced by the high-frequency power. The high-frequency alternating magnetic field 9 thus produced feeds eddy currents through only a thin solidification layer (penetration depth) on an inner surface of the outlet portion 21*b*. As a result, due to increasing electric power density in the thin solidification layer, the material 13 solidified on the inner surface of the outlet portion 21*b* of the tapping portion 21 melts from its surface and eventually the solidification layer drops down, and thereby the state of the tapping being enabled is brought about.

On the other hand, the upper induction heating coil 26*b* induces the eddy currents for a thin layer of the solidification layer which is in contact with the conductive segments 21*s* of the inlet portion 21*a*. As a result, due to pseudo heat insulating function, the skull 35 at the inlet portion 21*a* is melted at its solidification interface contacting with the molten material, as shown in FIG. 12(A). In other words, the part of the material which is in contact with the conductive segments 21*s* is subjected to induction heating to produce a pseudo heat insulating layer, by which heat absorption into the conductive segments 21*s* is suppressed to cause the melt to progress from the solidification interface 35". In addition, the flow V of the molten material at that part also encourages the reduction of the skull 35 at the inlet portion 21*a*, and eventually the skull 35 is reduced in thickness not only at the inlet portion 21*a* but also at the outlet portion 21*b* and is tapped by the pressure of the molten material.

Next, when the tapping of the molten material is stopped, low-frequency power of, for example, a commercial frequency is supplied from the melt-use power source 24 to the induction heating coil 26*a* at the outlet portion 21*b* and the induction heating coil 26*b* at the inlet portion 21*a*, as shown in FIG. 13. A low-frequency magnetic field caused by the low-frequency power induces eddy currents which run considerably deep into the molten material layer from the surface thereof. As a result, the electric power density is reduced, solely by which the magnetic pressure is brought about in the molten material, rather than by the induction heating. Due to this phenomenon, the flow area of the molten material is narrowed and thus the flow rate is suppressed at the outlet portion 21*b*, whereas the effect of raising the molten material upward is produced at the inlet portion 21*a*. As a result, the downward pressure is reduced and thereby the tapping amount of the molten material is reduced.

Thereafter, as the amount of the molten material passing through the tapping portion 21 falls, the amount of heat supplied from the molten material falls, so that the molten material begins to solidify at its part contacting with the conductive segments 21*s* at the inlet portion 21*a*. This causes a further reduction of the amount of molten material, and eventually the tapping is stopped. In addition, a similar effect is produced by simply stopping the high-frequency power supplied from the melt-use power source 24. In this case, the skull around the inlet portion 21*a* layers increases, so that the aperture 25 to the outlet portion 21*b* becomes blocked with the skull 35 to reduce the outflow of the molten material. As a result, the skull 35 increases further, so that the aperture 25 is eventually closed by the skull to stop the tapping, as in the case above.

In the third embodiment, the side wall 33 is so provided as to extend vertically, but this is not restrictive. The side wall may extend so obliquely as to increase in radius from the bottom 34 to the top edge portion. In this case, the adherence of the material 13 to the side wall 33 can be reduced, while the gas in the molten material can be fully eliminated, as in the case of the first and second embodiments.

Although the present invention has been described in its preferred embodiments, it is to be understood that the invention is not limited thereto and that various changes and modifications may be made without departing from the sprit and scope of the invention.

What is claimed is:

1. A bottom tapping mechanism in an induction heating furnace, including:

an inverted-hollow-cone-shaped aperture bored in a flat plate-like bottom of an accommodating vessel for accommodating therein a molten material;

a funnel-shaped tapping portion comprising an inlet portion formed within said integrally formed with and located below said inlet portion, said tapping portion being divided into a plurality of segments by a plurality of slits which are continuous to each other and connected to cooling water feed and discharge pipes;

integrally formed induction heating coils arranged around said tapping portion at the inlet portion and the outlet portion, respectively, a power source able to supply AC power to said induction heating coils at any selected frequency; and a power source control unit which controls the frequency of AC power such that the tapping portion is allowed to induce eddy currents at a deep layer from the surface of the molten material so as to close the tapping portion by solidification of the material when the material is melted, and to induce eddy currents at a thin layer from the surface of the molten material so as to open the tapping portion by melt of the material when the material is to be taken out.

* * * * *

UNITED STATES PATENT AND TRADEMARK OFFICE

CERTIFICATE OF CORRECTION

PATENT NO. : 6,385,231 B2
DATED : May 7, 2002
INVENTOR(S) : Tsuda et al.

It is certified that error appears in the above-identified patent and that said Letters Patent is hereby corrected as shown below:

Title page,
Item [45], and the Notice information should read:
-- [45] **Date of Patent: *May 7, 2002** --
-- [*] Notice: Subject to any disclaimer, the term of this patent is extended or adjusted under 35 U.S.C 154(b) by 0 days.

This patent is subject to a terminal disclaimer. --
Item [63], Related U.S. Application Data, should read:
-- Related U.S. Application Data
[63] Continuation of application No. 09/064,774, filed on Apr. 23, 1998, now Patent No. 6,307,875. --

Signed and Sealed this

Thirteenth Day of August, 2002

*Attest:*

*Attesting Officer*

JAMES E. ROGAN
*Director of the United States Patent and Trademark Office*